United States Patent [19]

Okunishi et al.

[11] 4,356,717

[45] Nov. 2, 1982

[54] METHOD AND APPARATUS FOR FORGE-SHAPING SHEET MEMBERS

[75] Inventors: Hiromu Okunishi, Sayamashi; Hideki Nakaji, Kawagoeshi; Hiroyuki Suwa, Sayamashi; Hideaki Sato, Kawagoeshi, all of Japan

[73] Assignee: Honda Giken Kogyo Kabushiki Kaisha, Tokyo, Japan

[21] Appl. No.: 182,080

[22] Filed: Aug. 28, 1980

Related U.S. Application Data

[63] Continuation of Ser. No. 782,407, Mar. 29, 1977, abandoned.

[30] Foreign Application Priority Data

Apr. 2, 1976 [JP] Japan ..... 51-36733

[51] Int. Cl.[3] ..... B21J 13/02

[52] U.S. Cl. ..... 72/342; 72/354

[58] Field of Search ..... 188/218 XL; 148/12.4; 29/159.01; 72/308, 309, 313, 334, 342, 347, 348, 350, 354, 356, 359, 397, 399

[56] References Cited

U.S. PATENT DOCUMENTS

| | | | |
|---|---|---|---|
| 1,457,772 | 6/1923 | Forsyth | 148/12.4 |
| 1,849,670 | 3/1932 | Glasner et al. | 72/336 |
| 2,116,805 | 5/1938 | Swanson . | |
| 2,118,018 | 5/1938 | Swanson | 72/342 |
| 2,744,746 | 5/1956 | Batz | 148/12.4 |
| 3,050,849 | 8/1962 | Etchison, Jr. et al. | 72/348 |
| 3,478,849 | 11/1969 | Hahm | 188/218 XL |
| 3,623,579 | 11/1971 | Hendrickson | 188/218 XL |
| 3,668,917 | 6/1972 | Komatsu et al. | 72/342 |
| 4,112,732 | 9/1978 | Okunishi et al. | 72/342 |
| 4,126,492 | 11/1978 | Okunishi et al. | 148/12.4 |

*Primary Examiner*—Lowell A. Larson

*Attorney, Agent, or Firm*—Irving M. Weiner; Pamela S. Burt; John L. Shortley

[57] ABSTRACT

A method and apparatus for forge-shaping sheet-shaped members having upper and lower dies for pressing and forge-shaping a sheet-shaped material heated to a quenching temperature or an imperfectly quenching temperature set from a required hardness. The apparatus also includes cooling ducts for quenching the forge-shape material. The material is continuously quenched as it is kept pressed.

8 Claims, 13 Drawing Figures

METHOD AND APPARATUS FOR FORGE-SHAPING SHEET MEMBERS

This is a continuation of application Ser. No. 782,407, filed Mar. 29, 1977, now abandoned.

The present invention relates to methods of forge-shaping sheet members, such as brake disks, and to apparatus for working the same.

More particularly, the invention relates to a method and apparatus wherein a plate-shaped material is heated, is hot-forge-shaped, is shaped to have a predetermined thickness, is compacted in structure, is press-shaped while being hot-forge-shaped, and is then quenched to obtain a high quality sheet-shaped member, such as a brake disk, clutch plate or sprocket, which is high in the precision of parallelism and flatness of both surfaces of the material.

BACKGROUND OF THE INVENTION

Brake disks excellent in high speed and high load stabilities are adopted for cars and have come to be adopted also for autobicycles or motorcycles due to their excellent brake performances.

The brake disks of such brakes are required to be heat-treated to be of a hardness required in consideration of the brake feeling characteristics, wear-resistance, and prevention of squeaking sounds of the brakes. Further, together with such hardness control, it is required to set and maintain at a high precision the parallelism and flatness of the disk portion, i.e., the pad sliding surface in sliding contact with the brake pad.

Not only the brake disk, but also the clutch plate, is required to have precision in the parallelism and flatness of the surface in addition to the surface hardness. Sprocket wheels and other devices also require such good qualities.

Such products are made from a sheet-shaped member. Even if the precision of the parallelism and flatness of the surface is set in advance, due to heat-treatments such as quenching and annealing, the surface will be strained and deformed and it will be difficult to obtain and/or maintain the precision in parallelism and flatness. Also, if the material is punched or draw-shaped in advance, the precision of the dimensions will decrease.

The brake disk is of a type wherein an annular disk portion forming a pad sliding surface, and a hub fitting portion are integrally shaped, or a type wherein they are separately shaped. Both types are selectively used depending on the size of the vehicle.

In both types of such brake disks, the annular disk portion on the outer periphery forming the pad sliding surface is required to be wear-resistant, to have a proper hardness due to such brake feeling performance as a slip, and to have very high precision in parallelism and flatness of the sliding friction surface. Further, in case the brake disk is used for an autobicycle, it will be exposed to the elements, and rainwater or the like will enter the friction surface, and it will therefore be required to be anticorrosive.

In a prior method of making such brake disk, a stainless steel plate material is heated to a quenching temperature, is put between the upper and lower dies of a press, is held to be prevented from being thermally deformed, is here hot-draw-shaped or punched, is then quenched to be press-quenched, and is annealed. A strain may be produced by such two heat-treatments or, as such shaping and heat-treatment are made only by holding the plate material, the irregularities on the material surface will not be removed. Therefore, the material surface must be corrected by mechanical operations, such as grinding and cutting, to increase the precision of the parallelism and flatness of the annular disk portion and to obtain a predetermined brake disk.

Such prior method requires quenching and annealing steps in the producing process, has therefore many heat-treating steps, and is not adapted to mass production. As the material is quenched and annealed while being held only to prevent deformation, the disk portion or the disk portion and hub fitting portion in the integrally shaped disk will be reduced and strained in parallelism and flatness. Because only the surface is held, concavo-convexities will be produced by the deformation by the strain, quenching and heating. The concavo-convexities of the material itself are not removed, and the thickness dimensions will be incorrect or fluctuate. It will be difficult to obtain precision in the flatness of the surface, and the proper sliding friction surface with the brake pad will not be able to be attained. To obtain precision in parallelism and flatness, after the shaping, mechanical operations, such as grinding and cutting, are required. Therefore, the number of steps will increase. The surface hardness of the shaped product is so high that tool life will be short in the mechanical operation. More production equipment will be required due to the above.

When the plate thickness of the material does not match the plate thickness required for the product, i.e., in case the plate thickness of the material is larger than the required plate thickness or is particularly considerably larger, with the prior method a predetermined product will not be able to be substantially obtained. A material of a rough plate thickness cannot be used for a product required to have precision in the plate thickness dimension. If a material of a predetermined thickness dimension is made in advance instead of a material of such rough plate thickness, the cost of the material will undesirably become so high as to affect the cost of such product. If the predetermined thickness dimension is obtained by mechanically working the material instead of the above, it will not be adapted to mass-production and will increase the cost. Further, the plate thickness of the material is different depending on the kind of the brake disk, i.e., on the kind of vehicle to be fitted with the brake disk. The plate thickness dimension required for the final product is different depending on the respective products, such as clutch plates, sprockets, etc., and is difficult to obtain with a standardized plate material. Therefore, it is desirable to obtain such products while maintaining the precision of the plate thickness dimension by selecting a plate material thicker than the final plate thickness dimension irrespective of whether or not such thicker plate material matches the final plate thickness dimension.

SUMMARY OF THE INVENTION

The invention provides a method of forge-shaping a sheet-shaped member, including the step of heating a sheet-shaped material to a predetermined temperature determined by a hardness required by the sheet-shaped member. The method also includes the step of inserting the heated sheet-shaped material while being kept heated between upper and lower dies. The sheet-shaped material is strongly pressed and forge-shaped in a portion thereof required to have parallelism and flatness.

The sheet-shaped material is continuously quenched while being kept pressed.

The bases of the present invention are: if the hardness required for a product is obtained by the selection of the material, the two heat-treating steps of quenching and annealing will not be required; when the heated material is not only held, but is also forged in the press-shaping and press-quenching steps, a parallelism and flatness of high precision will be obtained; and, even if the material plate thickness is rough and large, a final predetermined plate thickness dimension will be obtained.

An object of the invention is to provide a method of forge-shaping sheet members required to have a high precision in parallelism and flatness of the friction surface, e.g., brake disk or clutch plate, having a minimum of convenient steps.

Particularly, an object is to provide a forge-shaping method wherein a portion required to have a parallelism and flatness of a plate material is hot-pressed and forge-shaped to be plastically deformed and shaped to a very high precision. At the same time, the plate thickness dimension precision is maintained high, the material is heated to a quenching temperature required for the product or to a temperature range in which a required hardness is press-quenched, and is hot-press-shaped at the time of the forge-shaping. The product that is high in precision of parallelism, flatness and plate thickness dimension, and having a predetermined hardness, is obtained in continuous steps, one heat-treating step, and minimum steps.

An object is to provide a forge-shaping method wherein, as a portion requiring parallelism and flatness is hot-forged together with the hot-press-shaping and continued press-quenching steps, even if the plate thickness dimension of the plate material does not match the plate thickness dimension of the final product, this material will be able to be forged and shaped to be of a predetermined plate thickness dimension by a plastic deformation in the direction of the plate thickness. Thus, the range of selection of plate materials to be used can be widened, and a brake disk or the like of a predetermined plate thickness dimension can be shaped from a cheap standard steel plate without being restrained by the plate thickness dimension.

A further object is to provide a forge-shaping method wherein such portion required to have parallelism, flatness and mechanical strength as the annular disk portion of a brake disk is forged to be compacted in structure of said portion, and is simultaneously press-quenched so that a very favorable product may be simply and conveniently obtained.

A further object is to provide a forge-shaping method wherein a material is heated to an imperfectly quenching temperature range in which a hardness required for a brake disk is obtained and its annular disk portion or the like is hot-forge-shaped, is simultaneously hot-press-shaped to be draw-shaped and punched, and is then press-quenched while being forged and pressed to obtain a brake disk. The product, excellent in the precision of flatness and parallelism and having a hardness required for a brake disk, is obtained in one heat-treating step so that a brake disk high in wear-resistance, anticorrosion, brake feeling and braking function and issuing squeaking sounds as low as possible may be inexpensively shaped from a plate material rough in the plate thickness precision and high in surface roughness.

An object is to provide a forge-shaping apparatus for performing methods for attaining the above objects.

DETAILED DESCRIPTION

Figure 1:
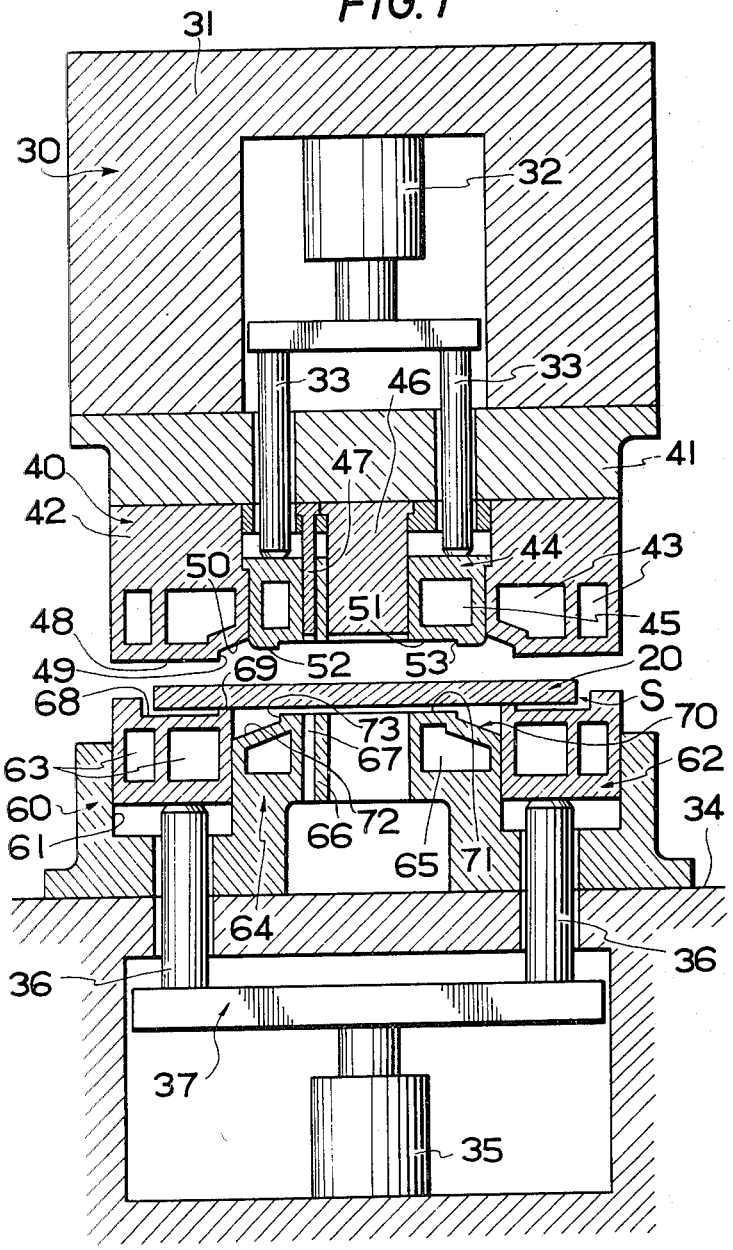
FIG. 1 is a vertical sectioned view showing an embodiment of an apparatus for performing the method of the invention, illustrating a method and apparatus for shaping integrally shaped brake disks.

FIGS. 1 to 4 show the forge-shaping of an integrally shaped brake disk as an embodiment of the forge-shaping of a sheet member according to the invention.

In a brake disk for an autobicycle or motorcycle, because the annular disk portion is exposed, there is a design problem, as it is exposed to rainwater or the like. The material and surface hardness are selected to give required anticorrosion and to prevent the brake slipping by the sliding friction with the brake pad, and to prevent squeaking sounds, and to increase wear-resistance. A stainless steel plate material is preferable.

A stainless steel plate material containing more than 10% Cr is selected for the material for shaping brake disks. More than 10% Cr is used because if less than 10% Cr is used a practical anitcorrosion is difficult to obtain. The preferable hardness of a brake disk in the HRC (Rockwell hardness on the C scale) range is 30 to 45. An optimum hardness is set in this range. The above-mentioned stainless steel plate material has an HRC of 50 to 53 in the generally used temperature range of 1050° to 1150° C. and is not desirable for a brake disk. Therefore, the above-quenched material is annealed at about 650° to be controlled to have a hardness in the HRC range of 30 to 45. However, in the embodiment of the brake disk of the present invention, this kind of material is treated at an imperfectly quenching temperature to obtain an HRC of 30 to 45.

In the brake disk shaping of this embodiment, a product of a required hardness is obtained in one heat-treatment. Further, by taking the above-mentioned conditions into consideration, a martensitic stainless steel plate material containing more than 10% Cr is used, and is hot-forged, hot-press-shaped and press-quenched. The quenching condition is to heat and hold the material in a temperature range (set by the hardness required for the brake disk) above the transformation point $A_1$, and continously forge, press-shape and quench it. When the material is quenched within this temperature range, which is a temperature condition lower than the general conventional quenching temperature, i.e., within the transformation point $A_1$ ranges of $\alpha+\gamma$ (ferrite+austenite) and $\alpha+\gamma+Cm$ (ferrite+austenite+cementite) in the generally known Fe−C state diagram, a mixed structure of martensite+ferrite+cementite or ferrite+martensite is obtained. Therefore, the material is controlled to an HRC of 30 to 45 by the amount of austenite, i.e., the heating temperature particularly at the time of heating to obtain a hardness required for a brake disk without subsequent annealing.

In the embodiment in which the invention is applied to forge-shaping a brake disk, the above-mentioned material is heat-treated at an imperfectly quenching temperature of a temperature condition lower than the general quenching, i.e., perfectly quenching temperature, to obtain a required surface hardness without requiring an annealing step, and is hot-forge-shaped prior to it.

The forge-shaping method according to the invention is explained in the following with reference to obtaining a brake disk. FIGS. 1 to 4 show the forge-shaping of an integrally shaped type brake disk in the order of steps.

The above-mentioned steel plate material is punch-shaped to be a disk in advance. The outside diameter is determined by considering the thickness of the material and the extrusion of the material in its peripheral portion by deformation of the plate thickness by forge-shaping. Due to the hot-forge-shaping under a pressure while hot, the plate thickness of the material may well be considerably larger than the final plate thickness dimension.

This disk-shaped material 20 is set in a forge-shaping machine 30 which is also a quench-pressing machine. Machine 30 is provided with an upper die 40 moved up and down with a ram 31, and a fixed lower die 60. Die 40 includes an outside die 42 formed to be ring-shaped below a fitting member 41 and provided with cooling water passages 43 therewithin. An intermediate movable upper die 44 is supported by an oil pressure cylinder unit 32 and a plurality of rods 33 together with ram 31 within outside die 42, and moves up and down in a predetermined range, and also has a cooling water passage 45 therewithin. A punch 46 for shaping an inside diameter hole of a brake disk, and punches 47 for shaping hub fitting holes, are provided in intermediate die 44.

Die 60 is fixed and set on a machine base 34 as a die holder. Die 60 is provided with a ring-shaped movable lower die 62 which is an outside lower die opposite outside upper die 42. Movable lower die 62 is slidably fitted in an annular cavity 61 in die 60, is supported on its lower surface with a die cushion 37 formed of a plurality of rods 36, and is provided with an internal cooling water passage 63. An intermediate lower die 64 is opposite intermediate die 44, is a fixed die formed integrally with die 60, and is provided with an internal water passage 65 and with holes 66 and 67 corresponding respectively to punches 46 and 47.

Outside movable lower die 62 has on its upper surface a ring-shaped shaping groove 68 provided with a flat surface for forging. Groove 68 has an inside diameter set to be larger than the anticipated amount of the plastic deformation in the radial direction in the forge-shaping of material 20, and has a projection 69 on its inner peripheral portion. A shaping portion 70 on the upper surface of the intermediate die 64 is formed to be a cone made flat in its central portion 71 to shape the hub fitting portion of a brake disk. A stepped portion 73 is formed between a male tapered sloped portion 72 and flat portion 71.

A flat portion 48 for forge-shaping is provided on the shaping lower surface portion of outside upper die 42. A female tapered sloped portion 50 is provided inside a stepped portion 40 on its inner peripheral portion. A stepped portion 53, corresponding to stepped portion 73, is provided on the central portion of intermediate movable upper die 44. A flat surface 51 for forging is provided on the central portion enclosed by stepped portion 53. A flat outer peripheral portion 52 is formed outside stepped portion 53.

Material 20 is heated to the imperfectly quenching temperature range in which the hardness required for a brake disk is obtained, and is mounted and set on the central portion of die 60 and kept heated so that a predetermined clearance S may be held between the peripheral edge portion of groove 68 and the outer periphery of material 20 as shown in FIG. 1.

Figure 2:
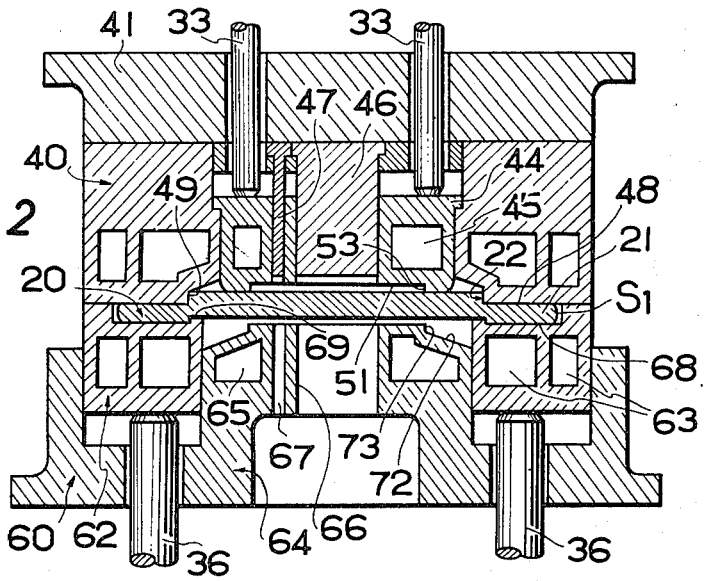
FIG. 2 is a view of a portion of FIG. 1, showing a forge-shaping step and a state of shaping a stepped portion attached to the outer peripheral side to prevent the collapse of the structure at the time of shaping.

First, ram 31 is driven to lower the outside upper die 42 and, as shown in FIG. 2, the outer peripheral portion, i.e., the annular disk portion 21, of material 20 is pressed between flat portion 48 of upper die 42 and the flat surface of groove 68 of the lower die 62, and is hot-forge-shaped. A stepped portion 22 is formed in the inner diameter portion of the annular disk portion 21 simultaneously with such forging by opposed projection 69 and stepped portion 49, to prevent flawing or escaping of the structure, thus preventing collapse and slip of the structure at the time of forging. Disk portion 21 is strongly pressed with surfaces 48 and 68 so that the surface structure may be made uniform and the surface may be flatly plastically deformed to set the plate thickness dimension. As shown in FIG. 2, portion 21 is reduced in thickness and deformed in the radial direction, and clearance S is reduced to $S_1$.

Figure 3:
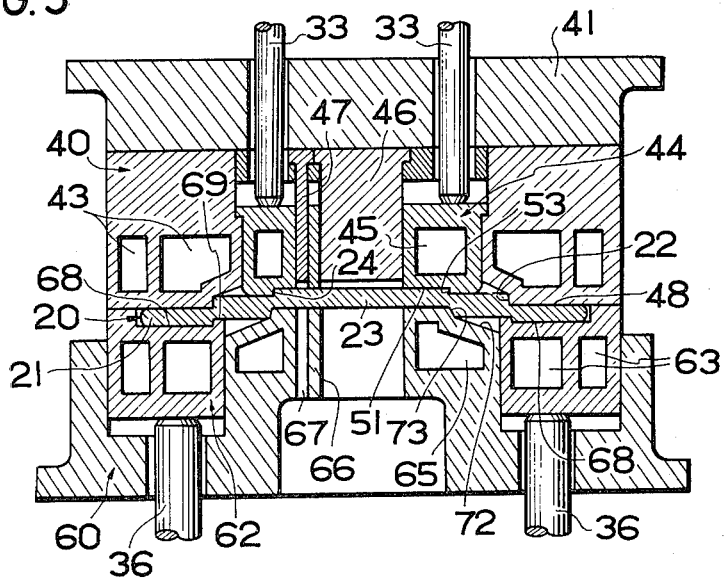
FIG. 3 is the same view as FIG. 2, showing the forge-shaping further advanced to shape a stepped portion on the inner peripheral side.
Figure 4:
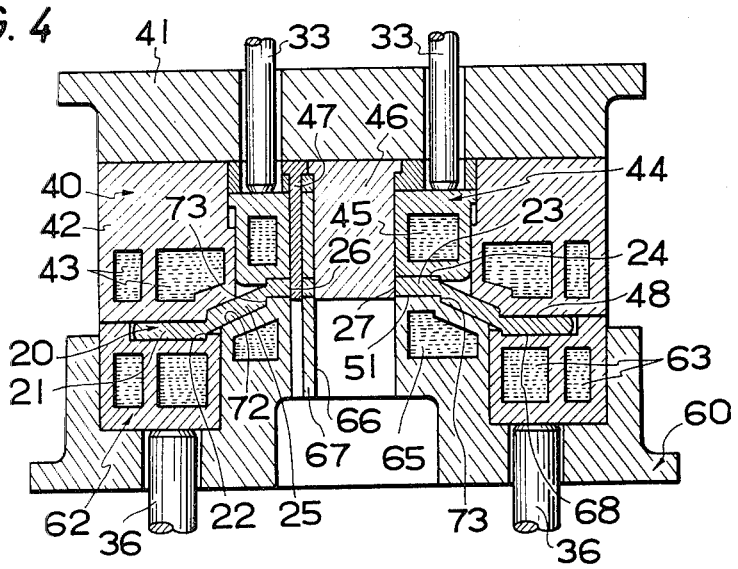
FIG. 4 is the same view as FIG. 3, showing a press-quenching state after draw-shaping.

Then, while maintaining a strong hold on material 20 during the above-mentioned forge-shaping, the cylinder unit 32 is driven to lower the die 44. A hub fitting portion 23 in the central portion of material 20 is strongly pressed by surface 51 of die 44 and surface 71 of die 64 so that the structure of the surface of this portion is made uniform, is flatly plastically deformed, and is hot-forged. A stepped portion 24 will be deformed in the outside diameter portion of portion 23 by opposing stepped portions 53 and 73 to prevent flawing or escaping of the structure, thus preventing collapse and slip of the structure at the time of the plastic deformation. This is shown in FIG. 3.

By the hot-forge-shaping of portions 21 and 23, the small concave-convexes, minute irregularities and flaws on the surface of the material are removed and a very flat surface is shaped. Because the central portion is forge-shaped while strongly pressing portion 21 even after the forging, parallelism is maintained at very high precision.

After such forge-shaping of the central portion ends, while keeping material 20 strongly pressed, ram 31 is lowered (FIG. 4) to hot-draw-shape the portion between portions 21 and 23 with the female and male tapered portions 50 and 72, respectively, to shape a truncated conical portion 25. Because portions 21 and 23 are held with the inside and outside stepped portions 22 and 24, the collapse or slip of the structure will not occur at the time of such draw-shaping. It will be understood that although steps 22, 24 will prevent the aforesaid flawing (i.e., escaping) of the structure during forging of the annular disk portion 21 and hub fitting portion 23, during such forging the metal will necessarily be slightly flawed in the central or interior portion by metal escaping from such forged portions to the intermediate unforged portion, in spite of the steps 22, 24, because a sufficient continuity is still maintained between the portions 21 and 25 and between the portions 23 and 25 in the central or interior portion of the structure. However, such slight flawing or escaping of the structure into the intermediate portion to be drawn prevents such portion from being subjected to excessive tensile force during drawing. Also, punches 46 and 47 are lowered to shape an axle inserting hole 26 and a plurality of hub fitting holes 27 in portion 23.

After the completion of such forge-shaping, draw-shaping and punch-shaping of the flat surface, while material 20 is kept strongly pressed (FIG. 4), cooling water is fed through passages 43, 45, 63 and 65 to quench and harden the shaped material 20.

Figure 5:
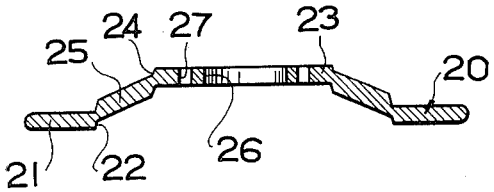
FIG. 5 is a vertically sectioned side view of a resulting integrally shaped brake disk.
Figure 6:
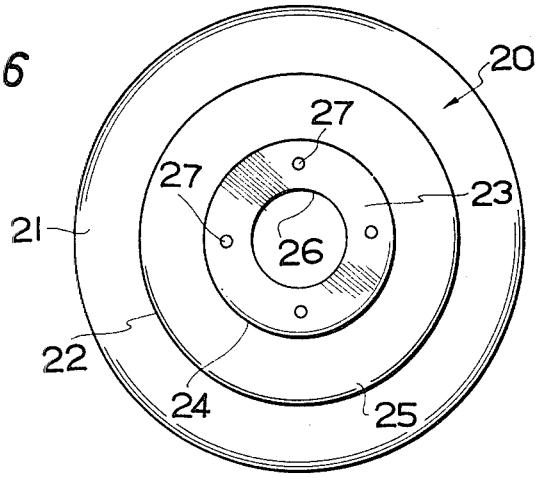
FIG. 6 is a plan view of FIG. 5.

Thus, the integrally shaped brake disk as shown in FIGS. 5 and 6 is obtained. It is then ground on the surface by, for example, buff-grinding, and is painted on the hub fitting portion to obtain a final product.

The amount of plastic deformation of the plate thickness by the forging must be small. For example, if the initial plate thickness is 5 mm, an amount of deformation of about 0.1 to 0.5 mm is preferable.

Due to the hot-forge-shaping, the resulting product has very high precision parallelism and flatness of both front and rear surfaces of portion 21, has the required optimum hardness by the above-mentioned imperfect quenching, and requires no subsequent annealing. Therefore, portion 21 can be immediately used as a pad sliding surface only with minor grinding work, such as buff-grinding. Both surfaces of portion 23 also have the same qualities. Because the stepped portions 24 and 22 are provided in the inside and outside diameter portions of portions 21 and 23, the springing back occurring at the time of the draw-shaping of conical portion 25 is effectively absorbed.

Material 20 is forge-shaped first in the outer peripheral portion and then in the central portion, but this sequence may be reversed. Further, the quenching cooling means may be of a spray type instead of the cooling water passages. Due to the forge-shaping, the outside diameter of the forged annular disk portion will become large. However, if the amount of deformation is allowable, it may be left as is and, if required, it may be corrected by mechanical operations, such as grinding and cutting. If the amount of plastic deformation of the plate thickness is small, and the amount of the deformation in the radial direction is also small, a suitable product is obtained without requiring such mechanical operations in case it is to be used for a brake disk.

Figure 7:
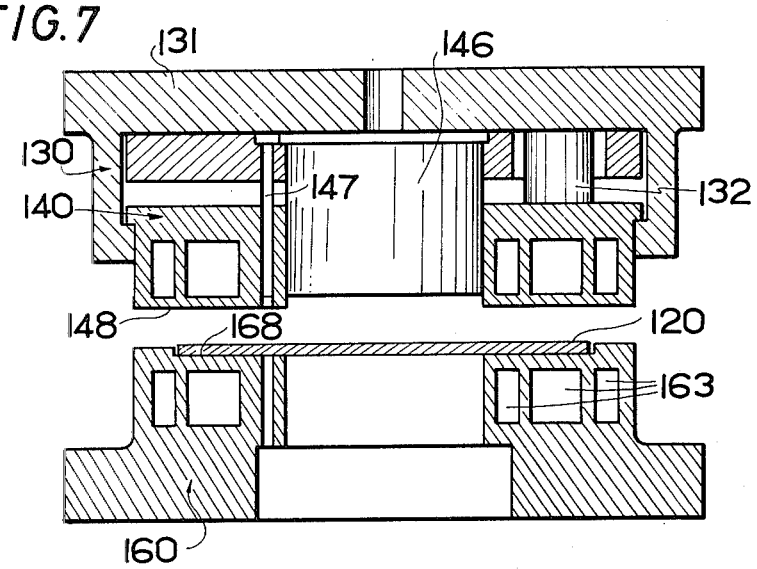
FIG. 7 is a vertical sectioned view showing another embodiment of a method and apparatus for forge-shaping disks of combined integral brake disks.
Figure 8:
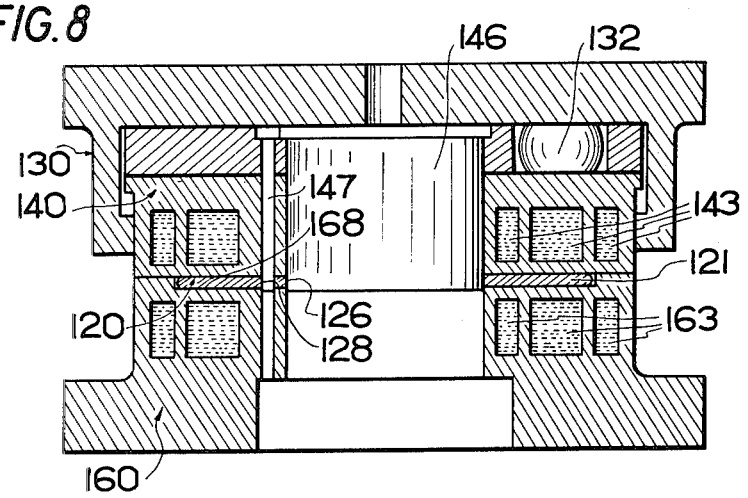
FIG. 8 depicts the FIG. 7 apparatus showing quenching after forge-shaping.
Figure 9:
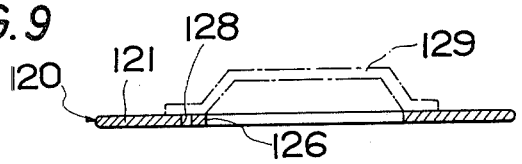
FIG. 9 is a sectioned side view of the disk member obtained by the FIGS. 7 and 8 embodiment.

FIGS. 7 to 9 show an embodiment of a brake disk wherein an annular disk and hub fitting portion are separately shaped, and are then combined to be integral with each other.

A forge-shaping machine 130 is provided with forging means, punching means in the illustrated embodiment, and cooling means that is simpler in structure than that of the first embodiment.

Material 120 to be used as the above-mentioned material is shaped to be a disk in the same manner and heated under the above-mentioned conditions as material 20. It is set on a flat shaping groove 168 of a lower die 160 which is a fixed die, and an upper die 140 which is a movable die to be lowered. Die 140 is moved up and down by a ram 131, is slidable up and down within ram 131, is supported with an elastic material 132, has a large diameter punch 146 and small diameter punches 147 in its central portion, and has a flat shaping portion 148 formed on its lower surface. As shown in FIGS. 7 and 8, material 120 is put between flat shaping portions 148 and 168, is strongly pressed on its outer peripheral portion 121 between them, and is hot-forge-shaped on both front and rear surfaces to be of a uniform structure on both surfaces, to be flatly plastically deformed, and to be reduced in thickness. At the same time, an inside diameter hole 126 and hub fitting holes 128 are punch-shaped with large and small punches 146 and 147, respectively, water passages 143 and 163 to quench and harden the material.

By the above, the annular disk member shown in FIG. 9 is obtained. A hub fitting member 129 is integrally combined with it by rivets or the like to obtain a brake disk. The parallelism and flatness of both surfaces of the disk portion 121 left to be annular will be maintained at a precision so high that, with only grinding or the like, a product of a high precision is immediately obtained as a brake disk.

Because each of the above embodiments is for shaping a brake disk, a martensitic stainless steel plate containing more than 10% Cr is used for the material. The required hardness is determined depending on the product. Any material other than the above-mentioned material may be selected, heated to the imperfectly quenching, i.e., general quenching temperature, hot-forge-shaped, press-shaped at the same time as required, and quenched.

The product obtained by the above forge-shaping together with the simultaneous quenching can be applied to any product required to be high in precision of parallelism and flatness of both surfaces, and to be quenched.

Figure 10:
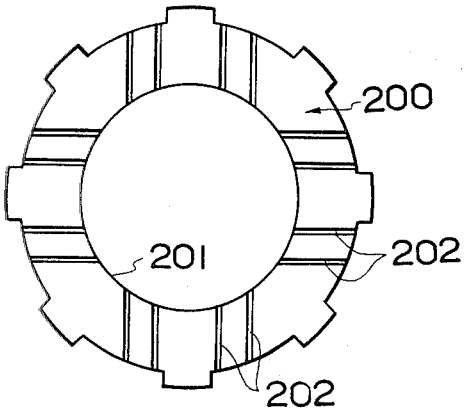
FIG. 10 is a top view of a clutch plate obtained by the present invention.
Figure 11:
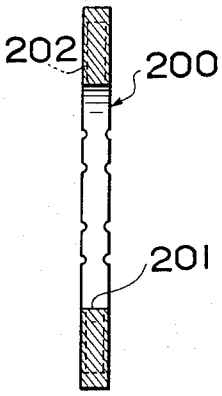
FIG. 11 is a sectioned side view of FIG. 10.
Figure 12:
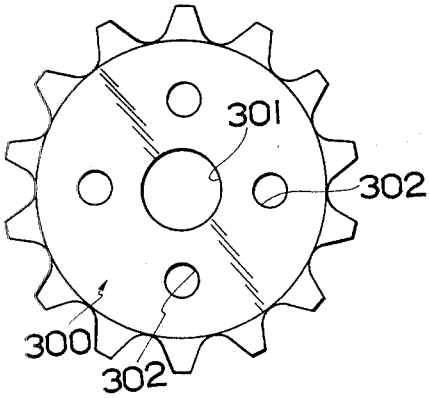
FIG. 12 is a top view of a sprocket obtained by the present invention.
Figure 13:
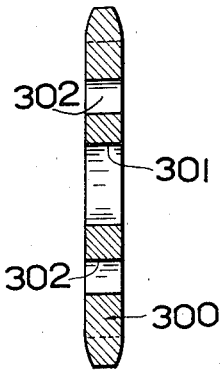
FIG. 13 is a sectioned side view of FIG. 12.

It can be applied to the shaping, for example, of clutch plate 200 shown in FIGS. 10 and 11, and sprocket wheel 300 shown in FIGS. 12 and 13. In both cases, holes 201, 301 and 302 and oil grooves 202 are shaped simultaneously with the forge-shaping, and the materials are continuously quenched to obtain desired products. The heating temperature condition at the time of the forge-shaping is set depending on the material and required hardness. The material may be heated not only to the imperfectly quenching temperature, but also to a perfectly quenching temperature, depending on the material, and may be quenched.

We claim:

1. A method of forge-shaping a brake disk, comprising the steps of:

heating a starting material to a predetermined temperature for attaining a hardness of 30 to 45 HRC required for said brake disk, said starting material having a flat standard steel plate shape and an initial thickness greater than a final thickness after shaping thereof;

inserting said heated material as kept heated between upper and lower dies;

strongly pressing and forge-shaping said material at an annular disk portion and a central hub-fitting portion thereof to remove irregularities thereon and to attain parallelism and flatness thereof, said material being plastically radially deformed during said forge-shaping such that a portion of said material escapes from said annular disk portion and said central hub-fitting portion to an intermediate portion therebetween;

drawing said intermediate portion of said material between said annular and central forge-shaped portions simultaneously with said forge-shaping; and continuously quenching said heated material while it is kept strongly pressed between said upper and lower dies.

2. A method according to claim 1, wherein:

said intermediate portion of said material is drawn simultaneously with said forge-shaping so as to shape a truncated conical portion of said brake disk; and said material is punched in said hub fitting portion to shape an axle inserting hole and hub fitting holes simultaneous with said drawing.

3. A method according to claim 1 or 2, wherein:

stepped portions are forge-shaped respectively in the inside diameter portion of said annular disk portion and the outside diameter portion of said hub fitting portion, on either side of said intermediate portion, at the time of said forge-shaping so as to substantially prevent flawing of said annular disk portion and said central hub-fitting portion during said forge-shaping.

4. A method according to claim 1, wherein:

said material comprises a martensitic stainless steel plate material; and said material is heated to a predetermined substantially lowered imperfect quenching temperature.

5. A method according to claim 1, wherein:

said method comprises a single heat-treatment step.

6. An apparatus for forge-shaping a brake disk, comprising:

first upper and lower dies for strongly pressing and forge-shaping an annular disk portion and a central hub-fitting portion of a flat standard steel plate material heated to a predetermined temperature for attaining a hardness of 30 to 45 HRC required for said brake disk such that a portion of said material between said dies escapes from said annular disk portion and said central hub-fitting portion to an intermediate portion therebetween;

draw-shaping means mechanically and operatively connected with said dies for drawing said intermediate portion of said material between said annular and central forge-shaped portions; and cooling means for continuously quenching the shaped material while said material is kept strongly pressed between said upper and lower dies.

7. An apparatus according to claim 6, wherein:

second upper and lower dies are provided in the outer peripheral portion and central portion, respectively of said first upper and lower dies, said dies being operatively cooperative for draw-shaping said intermediate portion of said material therebetween; and said cooling means comprises cooling water passages for feeding cooling water as required into said upper and lower dies so as to quench all portions of said shaped material.

8. An apparatus according to claim 6 or 7, further comprising:

punches mechanically and operatively connected with said dies for punch-shaping said central hub-fitting portion of said material; and stepped portions provided symmetrically in the inside diameter portion and outside diameter portion of the upper and lower dies for forge-shaping in the inside diameter portion of said annular disk portion and the outside diameter portion of said hub fitting portion, on either side of said intermediate portion, so as to substantially prevent flawing of said annular disk portion and said central hub-fitting portion.

* * * * *